United States Patent [19]

De Jong

[11] Patent Number: 4,720,267

[45] Date of Patent: Jan. 19, 1988

[54] CONNECTOR WITH INTERNAL ELECTRICAL CONNECTIONS TO BE MADE OPTIONALLY

[76] Inventor: Siegfried A. De Jong, Fahrenheitstraat 380, The Hague, Netherlands

[21] Appl. No.: 868,320

[22] Filed: May 28, 1986

[30] Foreign Application Priority Data

May 29, 1985 [NL] Netherlands ..... 8501533

[51] Int. Cl.[4] ..... H01R 13/66

[52] U.S. Cl. ..... 439/76; 439/279; 439/453; 439/458; 439/624

[58] Field of Search ..... 339/17 R, 17 C, 17 F, 339/103 B, 105, 106, 151 C; 439/76, 453–458, 279, 624, 701

[56] References Cited

U.S. PATENT DOCUMENTS

| | | | |
|---|---|---|---|
| 2,108,907 | 2/1938 | Te Pas | 173/322 |
| 3,327,280 | 6/1967 | Levine et al. | 339/36 |
| 3,391,381 | 7/1968 | Livingston | 339/143 R |
| 3,879,098 | 4/1975 | Lawrence et al. | 339/41 |
| 3,993,859 | 11/1976 | McNeel | 339/106 |
| 4,438,292 | 3/1984 | Woodall | 174/52 R |
| 4,445,741 | 5/1984 | Annoot | 339/49 R |
| 4,470,134 | 9/1984 | McNeel | 367/188 |
| 4,477,136 | 10/1984 | Smith | 339/105 |

FOREIGN PATENT DOCUMENTS

| | | | |
|---|---|---|---|
| 0113465 | 12/1983 | European Pat. Off. . | |
| 2209514 | 9/1973 | Fed. Rep. of Germany | 339/17 R |
| 1216692 | 4/1960 | France . | |
| 1344678 | 10/1963 | France . | |
| 295889 | 7/1963 | Netherlands . | |
| 398681 | 9/1933 | United Kingdom . | |
| 448643 | 6/1936 | United Kingdom | 339/103 B |
| 2104304 | 3/1983 | United Kingdom . | |
| 2044559 | 10/1985 | United Kingdom . | |

OTHER PUBLICATIONS

Article No. 20122 entitled "Electrical Connector with Multi-Function Cover", in Research Disclosure, Jan. 1981.

*Primary Examiner*—Neil Abrams

[57] ABSTRACT

A connector comprising at least two groups of electrically conducting elements extending outside of said connector, wherein for a first group, each element comprises a pin and for a second group, each element comprises a sleeve, the elements being separated by a distance from each other and being fixed to a fixing piece in a cavity formed by a base part and a closure part, and the elements being connected to conductor tracks of a printed wiring card provided in the cavity at the fixing piece. Conductors of a cable extending into the cavity are connected to the conductor tracks. Dependent on the arrangement of the conductor tracks on the card, strings of geophones, or other electrical devices, may be electrically connected in series or in parallel.

19 Claims, 18 Drawing Figures

CONNECTOR WITH INTERNAL ELECTRICAL CONNECTIONS TO BE MADE OPTIONALLY

BACKGROUND OF THE INVENTION

1. Field of the Invention

This invention relates to a connector comprising a casing having within the casing at least two groups of electrically conducting connecting elements led through a fixing piece and fixed to the fixing piece. The connecting elements each have at one end a pin or a sleeve. The pins and/or sleeves of each group are disposed at a distance from each other and parallel to each other and exposed to the environment in a respective coupling section. An electrically conducting connection can be obtained with a corresponding group of matching connecting elements of another unit. Respective conductors of a cable led into the casing from outside are connected to respective connecting elements.

The invention relates in particular to a connector for use in the field of seismic exploration. Each group of the connector has two connecting elements. A cable has two conductors which are connected to the respective connecting elements. The connecting elements may be connected outside the connector to a string of geophones. One coupling section of the connector may be coupled to another connecting unit which is connected to a main cable which leads to a measuring and control unit. The other coupling section of the connector may be coupled to another connector, optionally via an extension cable provided with coupling pieces at the ends thereof.

2. Description of the Related Art

A connector of this type is known from U.S. Pat. No. 4,445,741, the disclosure of which is incorporated herein by reference. In the known connector the conecting elements consist of two parallel rods disposed next to each other which each have a sleeve at one end and a pin at the other end. Apparently, the rods are fixed at a relatively large distance from the ends of the rods in the center of a fixing piece. Each of the conductors are led in a loop through passages formed in the fixing piece and the ends of the conductors are fixed to the rods. The rods, the fixing piece, and an end section of the cable are received in a sealing manner in a rubber casing cast in a manner such that a coupling section of one connector can be plugged in a sealing manner into a coupling section of another connector, a pin being plugged into a sleeve to obtain an electrical contact at the same time. In another embodiment of this known connector one of the two groups of connecting elements of a connector comprises only pins and another group comprises only sleeves. For use in the field of seismic exploration one group of connecting elements comprises in this case a thick pin and a thin pin for two different polarities and the other group comprises a sleeve with large inside diameter and a sleeve with small inside diameter, respectively, for polarities which correspond to the respective pins.

The known connector has as a disadvantage the fact that it is not suitable for electrically connecting strings of geophones in series if a number of connectors are coupled to each other and each cable emerging from a connector is connected to a string of geophones.

Because the coupling sections of the known connectors are formed at the ends of the connecting elements formed by rods, if a number of connectors of this type are coupled in series, a corresponding number of strings of geophones being electrically connected with each other in parallel, a long rod of connectors merging into each other is produced. When used in the field the connecting elements, in particular the sleeves, may easily be damaged under these circumstances by bending of the rod.

SUMMARY OF THE INVENTION

The present invention provides a connector of the above-mentioned type which distinguishes itself in that the groups of connecting elements are fixed at a distance from each other to the fixing piece in a manner such that all the pins and sleeves extend parallel to each other on one side of the fixing piece, and the connecting elements are connected at the fixing piece to conductor tracks provided on a printed wiring card. With a connector in accordance with the present invention, a choice can be made from various printed wiring cards which each have different patterns of conductor tracks.

As a first example, for a given printed wiring card the pins and sleeves with the same polarity can therefore be connected via the conductor tracks to each other and to a respective conductor of the cable so that if a number of connectors are coupled together the strings of geophones connector to the respective cables are electrically connected in parallel. As a second example, with another printed wiring card the connecting elements of one polarity can be connected via a conductor track to each other and the connecting elements of the other polarity can each be connected to a respective conductor of the cable so that if a number of connectors are coupled to each other, the strings of geophones connected to the cables are connected in series. As a third example, the connecting elements of one of the coupling sections of the last connector in the series chain may be short-circuited, which may take place by means of a suitable pattern of the conductor tracks inside the said connector itself or by means of a suitable, separate, short-circuiting connector.

Since the connectors can all be coupled to each other close to each other, the connecting elements all being within a relatively small area, damage to the connecting elements when used in the field is reduced.

Because a connector according to the present invention is suitable for being constructed with different printed wiring cards, the connector is preferably constructed in such a manner that the casing consists of a base part and a closure part which are fixed to each other in a sealing manner and at the same time form a hollow cavity, the fixing piece being disposed in the base part and the cable being led into the cavity in a manner such that the conductors of the cable are connected in the cavity to the connecting elements and/or the conductor tracks. As a result of this, assuming identical base parts and identical closure parts, by using different printed wiring cards correspondingly different connectors can be obtained. At the same time the end sections of cables with different diameters can be received in the hollow cavity of the connector.

In addition, the base part and the closure part are preferably to be detachably fixed to each other. As a result the connector is not only modular but also constructed in a demountable fashion, it being possible to replace defective parts thereof. Even if, as a result of too great a tensile force being exerted on the cable, the electrical connection of the conductors of the cable to the conductor tracks or to the connecting elements is disturbed, or if the cable outside the connector is damaged, these defects can be repaired with the connector being retained. In addition, the cable may be formed by the connection cable of a single geophone or of a string of geophones, the said cable being cut to the correct length and can be connected directly, i.e. without coupling pieces, to the respective connecting elements inside the connecotr.

In order to relieve the conductors inside the connector from tension, the connector is preferably constructed in the following manner. The closure part consists of rigid material. The closure part has a passage with a bearing edge between the cavity to be formed with the base part and the environment, for a rigid ring disposed in the cavity. The section of the passage increases in the direction of the cavity. A grummet of flexible material is disposed in the passage. The grummet extends to outside the closure part and the section of the grummet inside the passage touches the wall of the passage. The cable extends out of the cavity via the ring and the grummet to the outside. The cable has a barrier piece resting on the ring which counteracts movement of the cable toward the outside.

To provide a tension relief for the conductors inside the connector it is preferable, in addition, that the fixing piece has a tag extending through a recess of the printed wiring card. The tag has an eyelet. The conductors of the cable are wrapped with one or more windings around the edge of the eyelet.

The above-noted and other aspects of the present invention will become more apparent from a detailed description of preferred embodiments when read in conjunction with the drawings.

BRIEF DESCRIPTION OF THE DRAWINGS

The invention will further be described by reference to the accompanying drawings which illustrate particular embodiments of a connector in accordance with the present invention, wherein like members bear like reference numerals and wherein.

DESCRIPTION OF A PREFERRED EMBODIMENT

Figure 1:
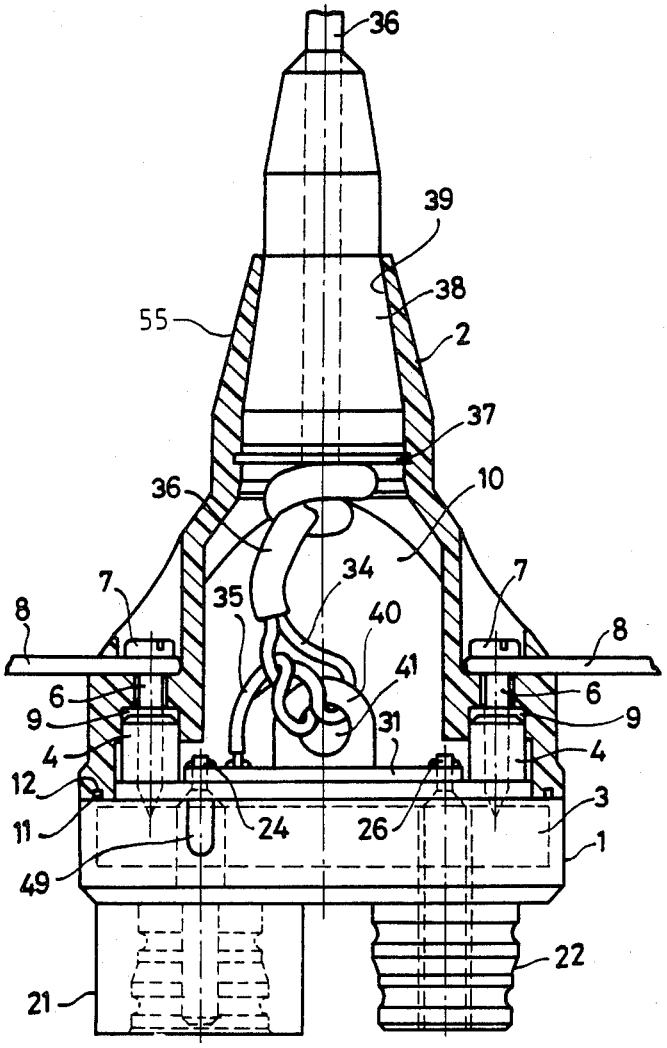
FIG. 1 is a cross-sectional view of the closure part of the connector according to the invention.

The connector shown in FIG. 1 comprises a casing 55 having a base part 1 of flexible rubber and a closure part 2 of hard insulating material. The base part 1 comprises a fixing piece 3 of hard insulating material. The closure part 2 and the fixing piece 3 may consist of nylon. The fixing piece 3 has projections 4 which extend into the closure part 2 and in which a hole 5 (see FIG. 4) with internal screw thread is formed. The base part 1 and the closure part 2 are fixed to each other by means of screws 6 screwed into the holes 5. Between the head 7 of a screw 6 and a bearing edge of the closure part 2 next to a passage for the screw 6 there is disposed an end section of a card 8 of a dust cap (not shown). Between the closure part 2 and the top face of the respective projection 4 the screw 6 passes through a ring 9 which consists of flexible material and which provides a seal for the cavity 10 formed between the base part 1 and the closure part 2. At the edge of the closure part 2 the base part 1 has a circumferential rib 11 which engages flexibly in a matching groove 12 of the closure part 2.

Figure 2:
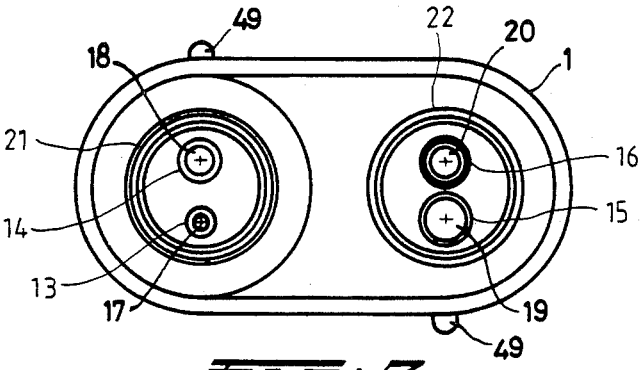
FIG. 2 is a bottom view of the connector of FIG. 1.
Figure 4:
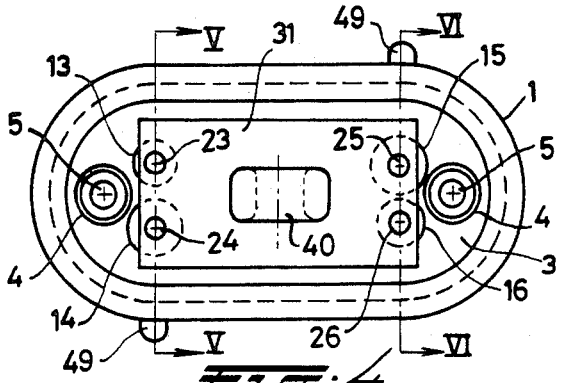
FIG. 4 is a plan view of the base part of FIG. 3.
Figure 3:
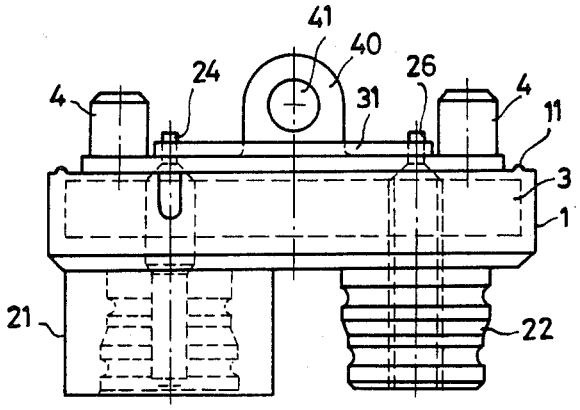
FIG. 3 is a view of the base part of the connector of FIG. 1 provided with a fixing piece and printed wiring card.

Referring now to FIG. 2 and FIG. 4, the fixing piece 3 is provided with four passages 13, 14, 15, 16 disposed in the corners of a rectangle. In the passages 13, 14, pins 17 and 18, respectively, are gripped. In the passages 15 and 16 sleeves 19 and 20, respectively, are gripped. The inside diameters of all the passages 13–16 are different to prevent interchanging of the pins and sleeves during the assembly.

Figure 5:
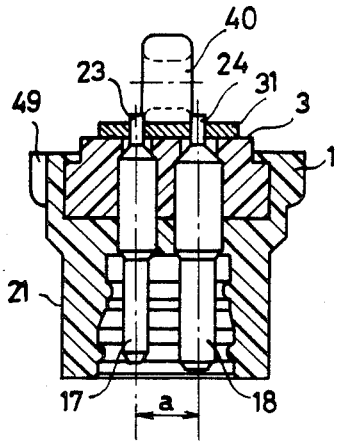
FIG. 5 is a cross-sectional view of the base part along the line V—V of FIG. 4.
Figure 6:
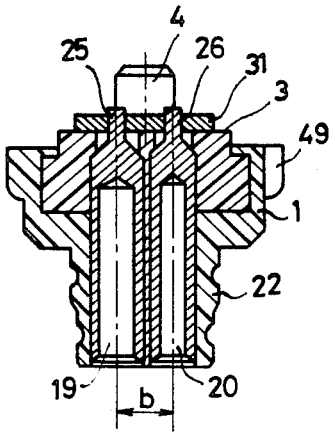
FIG. 6 is a cross-sectional view of the base part along the line VI—VI of FIG. 4.
Figure 8:
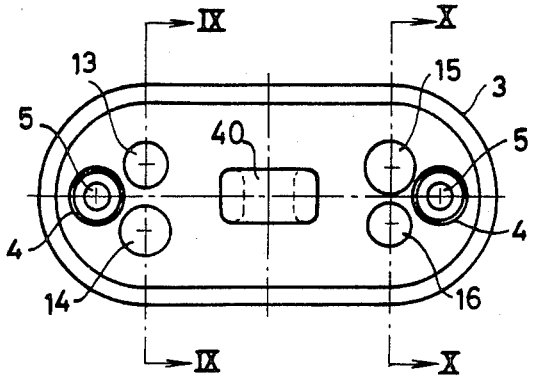
FIG. 8 is a plan view of the fixing piece of FIG. 7.
Figure 7:
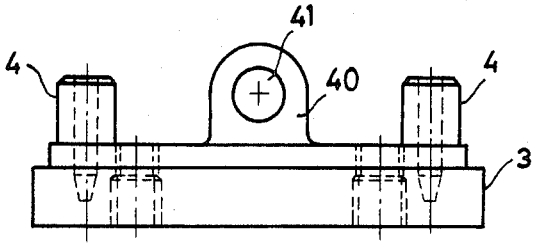
FIG. 7 is a view of the fixing piece of the connector of FIG. 1.
Figure 9:
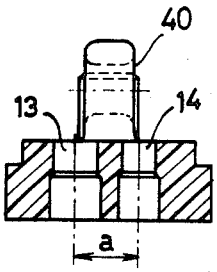
FIG. 9 is a cross-sectional view of the fixing piece along the line IX—IX of FIG. 8.
Figure 10:
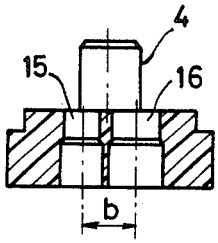
FIG. 10 is a cross-sectional view of the fixing piece along the line X—X of FIG. 8.

Referring now to FIG. 5 and FIG. 6, the pins 17, 18 and the sleeves 19, 20 form the connecting elements of the connector and are disposed in rubber coupling sections 21 and 22, respectively. Each section 21 and 22 has matching grooves and ribs at the circumference, in a manner such that a coupling section 22 of a connector can be plugged into a coupling section 21 of another connector in a sealing manner. At the same time the pins 17 and 18 can be plugged into the sleeves 20 and 19, respectively, of the coupling section 22 so that between the respective pins and sleeves an electrical contact is obtained. Pin 17 has a smaller diameter than pin 18, and sleeve 20 has a smaller diamter than sleeve 19. The thick pin 18, when plugged into the wide sleeve 19 forms a connection with positive polarity. The thin pin 17 when plugged into the narrow sleeve 20 forms a connection with negative polarity. The positive poalrity of pin 18 in sleeve 19 is indicated by means of thickenings 49 on the outside of the base part 1.

The center distance a between the pins 17, 18 is at the same time larger than the center distance b between the sleeves 19, 20. The center distance a is, for example, 12% larger than the center distance b. The inside diameters of the sleeves 19, 20 are larger, for example, by 3.5% than the diameters of the pins 18 and 17, respectively, to be connected to said sleeves. The section of each pin 17 and 18 which is gripped in the fixing piece 3 is thicker than the rest of the pin. In particular, the section which can be plugged into a sleeve is thicker in order to counteract the disadvantageous effect of a loosening movement.

On the side of the closure part 2 the ends of the pins 17 and 18 and sleeves 19 and 20 each form a small rod 23, 24, 25, and 26, respectively. Each rod passes through openings 27, 28, 29, and 30, respectively, (see FIG. 11 and FIG. 12) of a printed wiring card 31 which is disposed on the side of the closure part 2 against the fixing part 3 (see FIG. 1).

Figure 11:
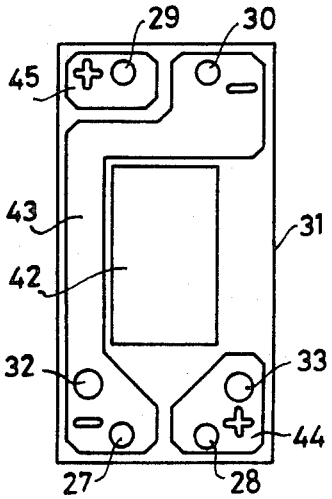
FIG. 11 is a plan view of the printed wiring card of the connector of FIG. 1.
Figure 12:
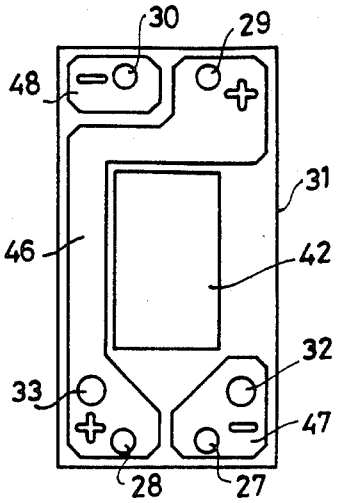
FIG. 12 is a bottom view of the printed wiring card of FIG. 11.

Referring now to FIG. 1, FIG. 11, and FIG. 12, the printed wiring card 31 has yet another system of openings 32 and 33 to allow through the bare ends of the conductors 34 and 35, respectively, of a cable 36. The cable 36 is led into the cavity 10 via a ring 37 and a grummet 38 of flexible material from outside the connector. In the end section of the cable 36 there is disposed a barrier, in particular in the form of a knot in the cable, which prevents the cable 36 being pulled out of the connector. The shape of the grummet 38 and the wall 39 of the closure part, with which the grummet 38 is in contact, are such that as a greater force in a direction originating from the connector is exerted on the cable 36, the grummet 38 is increasingly clamped against the wall 39. A radial force is thus exerted on the cable 36 in the passage in the grummet 38 so that the pulling of the cable 36 out of the cavity 10 is counteracted. In order to relieve the conductors 34 and 35 separately from tension, the fixing piece 3 has a projection 40 with a hole or passage 41. The projection 40 extends via a central recess 42 in the printed wiring card 31 into the cavity 10 of the closure part 2. The conductors 34 and 35 can then be passed several times through the hole 41.

Referring now to FIG. 11, the printed wiring card 31 has on one side a conductor track 43 which encompasses the openings 27 and 30 for connecting the pin 17 to the sleeve 20. The card 31 also has contact surfaces 44 and 45 for the pin 18 and the sleeve 19, respectively. Referring now to FIG. 12, on the other side of the card 31 there is disposed a conductor track 46 for connecting the pin 18 to the sleeve 19. Contact surfaces 47 and 48 are provided for the pin 17 and the sleeve 20, respectively. The holes 27, 28, 29, 30, 32, and 33 are plated throughout.

Figure 15:
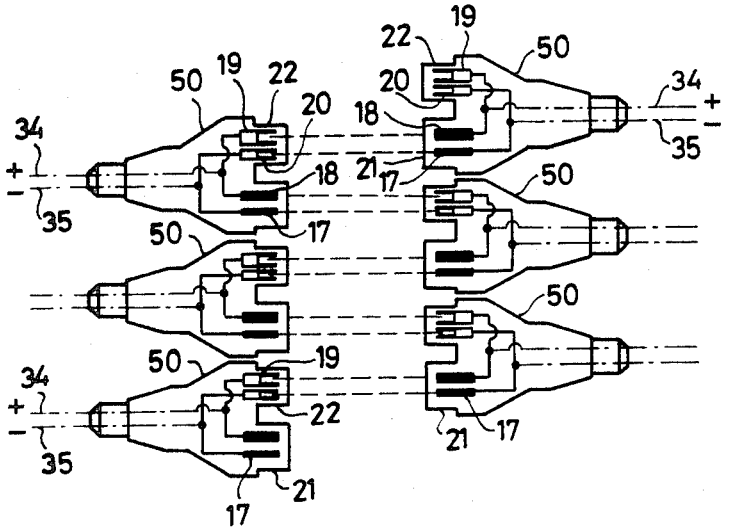
FIG. 15 is a diagrammatic representation of the coupling of a number of connectors provided with printed wiring cards to obtain string of geophones connected in parallel.
Figure 16:
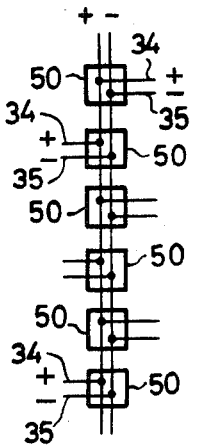
FIG. 16 is a diagrammatic representation of the electrical connections of the coupling according to FIG. 15.

Referring now to FIG. 15 and FIG. 16, the printed wiring card 31 illustrated in FIG. 11 and FIG. 12 is suitable for electrical connection in parallel of a number of strings of geophones which each have at the end of a cable 36 a connector of the type shown in FIG. 1.

FIG. 15 depicts a number of identical connectors 50 which are each provided with the printed wiring card 31 shown in FIG. 11 and FIG. 12. The electrical connections inside the connectors 50 and the locations of the sleeves and pins are shown diagrammatically. As shown, the connector 50 are coupled in a manner such that a coupling section 22 with sleeves 19 and 20 of one connector 50 is always plugged into a coupled section 21 with pins 17 and 18 of another connector 50. In this case the conductors 34 and 35 of the cables 36 of the different connectors 50 are connected in parallel with each other. The uppermost coupling section 22 or the lowermost coupling section 21 shown in FIG. 15 can be connected via another suitable connector to a main cable which leads to a measuring and control unit. FIG. 16 illustrates diagrammatically the electrical connections according to the coupling of FIG. 15.

Figure 13:
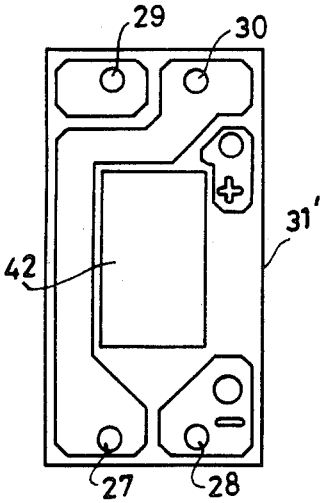
FIG. 13 is a plan view of another embodiment of the printed wiring card of the connector of FIG. 1.
Figure 14:
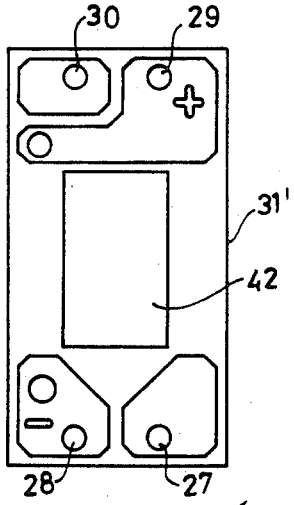
FIG. 14 is a bottom view of the printed wiring card of FIG. 13.
Figure 17:
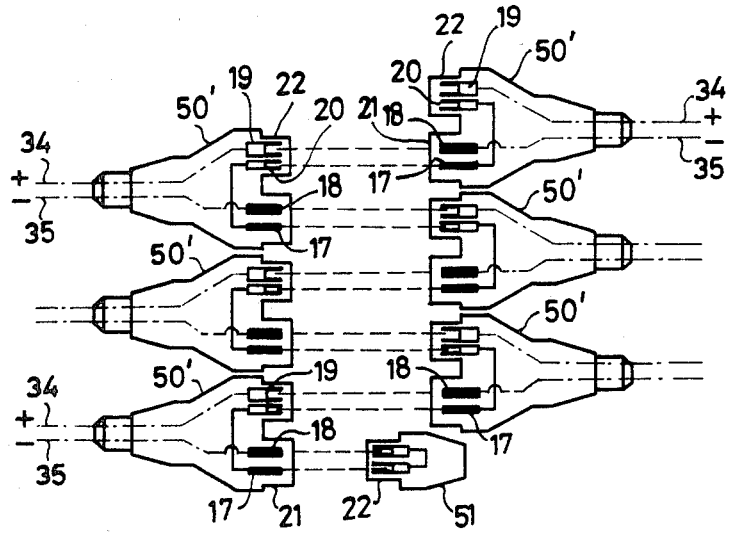
FIG. 17 is a diagrammatic representation of the coupling of a number of connectors with a printed wiring card for obtaining a series connection of strings of geophones.
Figure 18:
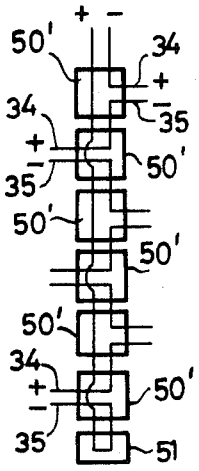
FIG. 18 is a diagrammatic representation of the electrical connections of the coupling according to FIG. 17.

FIG. 13 and FIG. 14 illustrate another embodiment of the printed circuit card 31 which, as explained with reference to FIG. 17 and FIG. 18, is suitable for the electrical connection is series of a number of strings of geophones which each have at the end of a cable a connector as shown in FIG. 1.

The connectors 50′ shown in FIG. 17 are identical to the connectors 50 except that instead of the printed circuit card 31, the card 31′ shown in FIG. 13 and FIG. 14 is fitted in each connector 50′. The connectors 50′ are coupled to each other in the same way as explained with reference to FIG. 15. A short circuit connector 51 with a coupling section 22 having short-circuited sleeves is in this case plugged into the coupling section 21 of one of the two end connectors 50′ of a group of connectors 50′. As shown diagrammatically in FIG. 18, with the coupling procedure of FIG. 17 a series connection is obtained of strings of geophones connected to the respective connectors 50′.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention. For example, the geophones of each string of geophones connected to a cable 36 can be connected with each other and with the conductors 34 and 35 of the cable 36 according to any arbitrary arrangement.

What is claimed is:

1. A connector for connecting a string of geophones to a main cable or to a main cable through another connector, comprising a casing, a fixing piece having an inside side and an outside side, and a removable printed wiring card having conductor tracks, the casing and the fixing piece forming an enclosure within which the printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the groups of electricaly conducting connecting elements are fixed at a distance from each other to the fixing piece in a manner such that all the pins and sleeves extend parallel to each other on the outside of the fixing piece; and (e) the electrically conducting connecting elements on the inside side of the fixing piece are connected to the conductor tracks provided on the printed wiring card.

2. A connector according to claim 1, whereby the casing consists of a base part and a closure part which are fixed to each other in a sealing manner and at the same time form a hollow cavity, the fixing piece being disposed in the base part and the cable being led into the cavity in a manner such that the conductors of the cable are connected in the cavity to the conductor tracks.

3. A connector according to claim 1, whereby the casing consists of a base part and a closure part which are fixed to each other in a sealing manner and at the same time form a hollow cavity, the fixing piece being disposed in the base part and the cable being led into the cavity in a manner such that the conductors of the cable are connected in the cavity to the conductor tracks and whereby the base part and the closure part are detachable fixed to each other.

4. A connector according to claim 1, whereby the casing consists of a base part and a closure part which are fixed to each other in a sealing manner and at the same time form a hollow cavity, the fixing piece being disposed in the base part and the cable being led into the cavity in a manner such that the conductors of the cable are connected in the cavity to the conductor tracks, and whereby:

(a) the closure part consists of rigid material;
(b) the closure part has a passage between the cavity to be formed with the base part and the environment;
(c) the diameter of the passage increases in the direction of the cavity;
(d) there is disposed in the passage a grummet of flexible material which extends to outside the closure part;
(e) the section of the grummet inside the passage touches an inside side of a wall of the passage;
(f) a rigid ring is disposed betwen the cavity and the grummet;
(g) the cable being led out of the cavity via the ring and the grummet to the outside; and
(h) the cable having a knot resting against the ring which counteracts movement of the cable toward the outside, so that as the cable moves toward the outside, the knot presses the ring against the grummet, and the grummet exerts a force against the inside side of the wall.

5. A connector according to claim 1, whereby the casing consists of a base part and a closure part which are fixed to each other in a sealing manner and at the same time form a hollow cavity, the fixing piece being disposed in the base part and the cable being led into the cavity in a manner such that the conductors of the cable are connected to the cavity to the conductor tracks, the base part and the closure part are detachable fixed to each other, and whereby:

(a) the closure part consists of rigid material;
(b) the closure part has a passage between the cavity to be formed with the base part and the environment;
(c) the diameter of the passage increases in the direction of the cavity;
(d) there is disposed in the passage grummet of flexible material which extends to outside the closure part;
(e) the section of the grummet inside the passage touches an inside side of wall of the passage;
(f) a rigid ring is disposed between the cavity and the grummet;
(g) the cable being led out of the cavity via the ring and the grummet to the outside; and
(h) the cable having a knot resting against the ring which counteracts movement of the cable toward the outside.

6. A connector according to claim 1, whereby the fixing piece has a tag extending through a recess of the printed wiring card and having an eyelet therein, and the conductors of the cable are wrapped with one or more widings around an edge of the eyelet.

7. A connector comprising a casing, a fixing piece having an inside side and an outside side, and a removable printed wiring card having conductor tracks, the casing and the fixing piece forming an enclosure within which the printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;
(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;
(c) respective conductors of a cable extending into the casing from the outside are connected to respective conductor tracks;
(d) the groups of electrically conducting connecting elements are fixed at a distance from each other to the fixing piece in a manner such that all the pins and sleeves extend parallel to each other on the outside of the fixing piece; and
(e) the electrically conducting connecting elements on the inside side of the fixing piece are connected to the conductor tracks provided on the printed wiring card;

wherein the fixing piece has a tag extending through a recess of the printed wiring card and having an eyelet therein, and the conductors of the cable are wrapped with one or more windings around an edge of the eyelet.

8. A connector for connecting a string of geophones to a main cable or to a main cable through another connector, comprising a casing, a fixing piece having an inside side and an outside side, and a printed wiring card having conductor tracks, the casing and the fixing piece forming an enclosure within which the printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the groups of electrically conducting connecting elements are fixed at a distance from each other to the fixing piece in a manner such that the pins form a first plane and the sleeves form a second plane, and both planes extend parallel to each other on the outside of the fixing piece; and (e) the electrically conducting connecting elements on the inside side of the fixing piece are connected to the conductor tracks provided on the printed wiring card.

9. A connector for connecting a string of geophones to a main cable or to a main cable through another connector, comprising a casing, a fixing piece having an inside side and an outside side, and a first removable printed wiring card having conductor tracks, the casing and the fixing piece forming an enclosure within which the first printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the electrically conducting connecting elements on the inside side of the fixing piece are connected to the conductor tracks provided on the first printed wiring card;

wherein when the connector is connected to other connectors having the first removable printed wiring card, the connector and the other connectors are connected electrically in series, and when the first removable printed wiring card is replaced with a second removable printed wiring card and the connector is connected to other connectors having the second removable printed wiring card, the connector and the other connectors are connected electrically in parallel.

10. A connector for connecting a string of geophones to a main cable or to a main cable through another connector, comprising a casing, a fixing piece having an inside side and an outside side, and a printed wiring card having conductor tracks, the casing and the fixing piece forming an enclosure within which the printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtaned with a corresponding group of matching electrically conducting connecting elements of another unit;

(c) respective conductors of a cable extending into the casing from the outside are connected to respective conductor tracks;

(d) the electrically conducting connecting elements on the inside side of the fixing piece are connected to the conductor tracks provided on the printed wiring card;

wherein the distance between centers of the pins is not substantially greater than twelve percent greater than the distance between centers of the sleeves.

11. A connector for connecting a string of geophones to a main cable or to a main cable through another connector, comprising a casing, a fixing piece having an inside side and an outside side, and a first removable printed wiring card having conductor tracks, the casing and the fixing piece forming an enclosure within which the first printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the groups of electrically conducting connecting elements are fixed at a distance from each other to the fixing piece in a manner such that the pins form a first plane and the sleeves form a second plane, and both planes extend parallel to each other on the outside of the fixing piece; and (e) the electrically conducting connecting elements on the inside side of the fixing piece are connected to the conductor tracks provided on the first printed wiring card;

wherein when the connector is connected to other connectors having the first removable printed wiring card, the connector and the other connectors are connected electrically in series, and when the connector has a second removable printed wiring card and is connected to other connectors having the second removable printed wiring card, the connector and the other connectors are connected electrically in parallel.

12. A connector for connecting a string of geophones to a main cable or to a main cable through another connector, comprising a casing, a fixing piece having an inside side and an outside side, and a first removable printed wiring card having conductor tracks, the casing and the fixing piece forming an enclosure within which the first printed wiring card is removably located, the connector having at least two groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the electrically conducting connecting elements on the inside side of the fixing piece are connected to the conductor tracks provided on the first printed wiring card;

wherein the distance between centers of the pins is not substantially greater than twelve percent greater than the distance between centers of the sleeves; and wherein when the connector is connected to other connectors having the first removable printed wiring card, the connector and the other connectors are connected electrically in series, and when the connector has a second removable printed wiring card and is connected to other connectors having the second removable printed wiring card, the connector and the other connectors are connected electrically in parallel.

13. A connector for connecting a string of geophones to a main cable or to a main cable through another connector, comprising a casing, a fixing piece having an inside side and outside side, and a first removable printed wiring card having conductor tracks, the casing and the fixing piece forming an enclosure within which the first printed wiring card is removably located, the connector having at least groups of electrically conducting connecting elements extending outside said casing through the fixing piece and fixed to the fixing piece, wherein:

(a) for a first group, each electrically conducting connecting element comprises a pin on the outside side of said fixing piece, and for a second group, each electrically conducting connecting element comprises a sleeve on said outside side;

(b) the electrically conducting connecting elements of each group on said outside side of said fixing piece are disposed at a distance from each other and parallel to each other and exposed to the environment in a respective coupling section for the respective group so that an electrically conducting connection can be obtained with a corresponding group of matching electrically conducting connecting elements of another unit;

(c) respective conductors of a cable extending into the casing from the outside are connected to respective conductor tracks;

(d) the groups of electrically conducting connecting elements are fixed at a distance from each other to the fixing piece in a manner such that the pins form a first plane and the sleeves form a second plane, and both planes extend parallel to each other on the outside of the fixing piece; and (e) the electrically conducting connecting elements on the inside side of the fixing piece are connected to the conductor tracks provided on the first printed wiring card;

wherein the distance between centers of the pins is not substantially greater than twelve percent greater than the distance between centers of the sleeves; and wherein when the connector is connected to other connectors having the first removable printed wiring card, the connector and the other connectors are connected electrically in series, and when the connector has a second removable printed wiring card and is connected to other connectors having the second removable printed wiring card, the connector and the other connectors are connected electrically in parallel.

14. A connector for a seismic cable having two conductors, comprising:

a two-part casing adapted at a first longitudinal end to receive an end of the seismic cable in sealed relation, and terminating at its second longitudinal end in two longitudinally disposed coupling sections;

said casing parts comprising a base casing portion one end of which is said second longitudinal end, and a closure portion one end of which is said first longitudinal end; the other ends of said casing portions being configured to be joined in a detachable, sealed relation to define a cavity extending toward said first longitudinal end and capable of receiving the end of the seismic cable;

two connector elements positioned in each said coupling section and each said coupling section adapted to connect non-interchangeably with mating connector elements in another such cable connector;

said cavity also capable of receiving a retrievable printed wiring card in a manner to interconnect said cable conductors with said connector elements in a preselected combination; and a fixing piece within said cavity attachable to said casing, said connector elements and said cable end to fix said cable and said conductor elements relative to said casing.

15. The connector of claim 14 further comprising at least two printed circuit cards, each card configured to interconnect said cable conductors with said connector elements in a separate preselected combination.

16. The connector of claim 14 in which the two connector elements in one of the coupling sections are both pin-type elements, and the two connectors in the other coupling section are sleeve-type elements.

17. The connector of claim 14 further comprising a removable grummet adapted to fit within the first longitudinal end of the closure portion and around said end of the cable to effect said sealed relation between said cable and said casing.

18. A connector for a seismic cable which has a positive conductor and a negative conductor, comprising:

a base casing portion having an open end, and a closed end terminating in a male-type coupling section and a spaced female-type coupling section, said coupling sections configured to engage mating coupling sections of another such connector in a detachable, sealed relation;

a closure casing portion having an open end adapted to engage the open end of the base casing portion in a detachable, sealed relation, and a closed end which is adapted to receive a seismic cable in a sealed relation and which defines a cavity opening to the open end of the closure casing portion;

each coupling section of the base portion defining a pair of spaced passageways extending the length of the coupling section;

a fixing piece disposed within the open end of the base casing portion to span the inner ends of said passageways, and attachable to the base casing portion when spanning said inner ends;

a separate electrical connector element of a preselected polarity positioned in each one of said passageways with its inner end extending through the fixing piece in a gripping relation, and with its outer end extending along its coupling section to be releasably coupled with a mating electrical connector element of another such connector; and a removable printed wiring card attachable to the internal surface of the fixing piece to contact and interconnect the conductors of the cable and the inner ends of the connector elements so as to establish a preselected circuit relationship between said connector elements and said conductors.

19. A connector for a seismic cable which has a positive conductor and a negative conductor comprising:

a two-piece casing including a base portion and a closure portion in longitudinally juxtaposed relation;

said base portion having an open proximal end and a closed distal end terminating in a male-type coupling section and a spaced female-type coupling section, said coupling sections configured to engage mating coupling sections of another such connector in a detachable, sealed relation;

said closure portion having an open proximal end adapted to engage the proximal end of the base portion in a detachable, sealed relation, and a closed distal end which is adapted to receive a seismic cable in a sealed relation and which defines a cavity opening toward the proximal end of the closure portion;

each coupling section of the base portion defining a pair of spaced passageways extending the length of the coupling section;

a fixing piece disposed within the open proximal end of the base portion to span the inner ends of said passageways, and attachable to the base portion when spanning said inner ends;

a separate electrical connector element of a preselected polarity positioned in each one of said passageways with its proximal end extending through the fixing piece in a gripping relation, and with its distal end extending substantially the length of its coupling section to be coupled with a mating electrical connector element of another such cable connector; and a removable printed wiring card attachable to the interior surface of the fixing piece to contact and interconnect the conductors of the cable and the inner ends of said connector elements so as to establish a preselected circuit relationship between said connector elements and said conductors.

* * * * *